US010049850B2

(12) United States Patent
Ollinger et al.

(10) Patent No.: US 10,049,850 B2
(45) Date of Patent: Aug. 14, 2018

(54) X-RAY APPARATUS WITH DEFLECTABLE ELECTRON BEAM

(71) Applicant: Bruker AXS GmbH, Karlsruhe (DE)

(72) Inventors: Christoph Ollinger, Karlsruhe (DE); Carsten Michaelsen, Artlenburg (DE); Andreas Kleine, Hamburg (DE); Juergen Graf, Rosengarten (DE)

(73) Assignee: Bruker AXS GmbH, Karlsruhe (DE)

( * ) Notice: Subject to any disclaimer, the term of this patent is extended or adjusted under 35 U.S.C. 154(b) by 0 days.

(21) Appl. No.: 14/841,726

(22) Filed: Sep. 1, 2015

(65) Prior Publication Data

US 2015/0380202 A1 Dec. 31, 2015

Related U.S. Application Data

(63) Continuation of application No. 13/706,374, filed on Dec. 6, 2012.

(51) Int. Cl.
*H01J 35/30* (2006.01)
*H01J 35/08* (2006.01)
(Continued)

(52) U.S. Cl.
CPC ..... *H01J 35/30* (2013.01); *G21K 1/067* (2013.01); *H01J 35/08* (2013.01); *H01J 35/14* (2013.01);
(Continued)

(58) Field of Classification Search
CPC ..... H01J 35/14; H01J 35/30; H01J 2235/086; H01J 35/065; H01J 35/24; H01J 35/22
See application file for complete search history.

(56) References Cited

U.S. PATENT DOCUMENTS 5,315,113 A 5/1994 Larson
5,602,899 A 2/1997 Larson
(Continued)

FOREIGN PATENT DOCUMENTS

JP 63123000 5/1988
JP 11 023 800 1/1999
(Continued)

OTHER PUBLICATIONS

K. Kanaya et al., "Penetration and energy-loss . . . ", J.Phys.D: Appl. Phys., vol. 5, 1972.
(Continued)

*Primary Examiner* — Brooke Purinton
(74) *Attorney, Agent, or Firm* — Paul Vincent

(57) ABSTRACT

An x-ray apparatus (1), has an electron beam source (2), a target (4), onto which the electron beam (3) is directed to form a focal spot (5; 5*a*, 5*b*) on the target (4), x-ray optics (6) for collecting x-rays emitted from the focal spot (5; 5*a*, 5*b*) to form an x-ray beam (8) and a sample position (9) at which the x-ray beam (8) is directed. The x-ray apparatus (1) further includes an electrostatic or electromagnetic electron beam deflection device (10) suitable for moving the focal spot (5; 5*a*, 5*b*) on the target (4). The extension of the focal spot (5; 5*a*, 5*b*) in any direction (x, y, z) is at least a factor of 1.5 smaller than the extension of the target (4). An x-ray apparatus is thereby provided with simplified alignment of the x-ray optics with respect to a microfocus x-ray source.

17 Claims, 10 Drawing Sheets

(51) Int. Cl.

| | |
|---|---|
| ***H01J 35/14*** | (2006.01) |
| ***H05G 1/58*** | (2006.01) |
| *G21K 1/06* | (2006.01) |

(52) U.S. Cl.

CPC ..... *H05G 1/58* (2013.01); *G21K 1/06* (2013.01); *H01J 2235/082* (2013.01); *H01J 2235/086* (2013.01)

(56) References Cited

U.S. PATENT DOCUMENTS

| | | | | |
|---|---|---|---|---|
| 5,712,889 | A * | 1/1998 | Lanzara | G01N 23/046 378/113 |
| 6,292,538 | B1 * | 9/2001 | Hell | H01J 35/14 378/137 |
| 7,929,667 | B1 | 4/2011 | Zhuang | |
| 2003/0006379 | A1 | 1/2003 | Hino | |
| 2003/0219097 | A1 | 11/2003 | Buijsse | |
| 2008/0043920 | A1 * | 2/2008 | Liu | H01J 35/065 378/138 |
| 2008/0075234 | A1 * | 3/2008 | Seijbel | B82Y 10/00 378/207 |
| 2009/0141864 | A1 | 6/2009 | Hertz | |
| 2010/0231130 | A1 | 9/2010 | Labetski | |
| 2011/0085644 | A1 | 4/2011 | Verman | |
| 2011/0188625 | A1 * | 8/2011 | Roshi | H01J 35/06 378/4 |
| 2011/0255668 | A1 * | 10/2011 | Hoghoj | B82Y 10/00 378/132 |
| 2012/0128122 | A1 * | 5/2012 | Kautz | A61B 6/4021 378/16 |
| 2013/0051532 | A1 * | 2/2013 | Caiafa | H01J 35/18 378/110 |
| 2015/0187538 | A1 * | 7/2015 | Canfield | H01J 35/06 378/113 |

FOREIGN PATENT DOCUMENTS

| | | |
|---|---|---|
| JP | 2003 518252 | 6/2003 |
| JP | 2003 344596 | 12/2003 |
| JP | 2004 505421 | 2/2004 |
| JP | 2006 185 866 | 7/2006 |
| JP | 4486610 | 10/2007 |
| JP | 2007267971 | 10/2007 |
| JP | 2009 537062 | 10/2009 |
| JP | 2010 217098 | 9/2010 |
| JP | 2011 516892 | 5/2011 |
| WO | WO 2011122020 | 10/2011 |

OTHER PUBLICATIONS

Sadao Aoki et al., "A Soft X-Ray Microprobe . . . ", Japanese Journal of Applied Physics/Part 1: Regular Papers & Short Notes, Oct. 1987, No. 10, Tokyo, JP.

D.H. Larsson et al., "A 24 keV liquid-metal-jet . . . ", Review of Scientific Instruments 82, 123701, (2011).

Oscar Hemberg et al., "Liquid-metal-jet anode . . . ", Opt. Eng. 43(7) 1682-1688 (Jul. 2004).

Translation of JP Application No. 2013-252054 Office action dated Jan. 12, 2016.

Ewen, Klaus 'Moderne Bildung', Georg Thieme Verlag Stuttgart, New York 1998, p. 82.

* cited by examiner

X-RAY APPARATUS WITH DEFLECTABLE ELECTRON BEAM

This application is a continuation of Ser. No. 13/706,374 filed Dec. 6, 2012 the entire disclosure of which is hereby incorporated by reference.

BACKGROUND OF THE INVENTION

The invention relates to an X-ray apparatus, comprising an electron beam source, emitting an electron beam, a target, onto which the electron beam is directed, thus forming a focal spot on the target, X-ray optics, collecting X-rays emitted from the focal spot and forming an X-ray beam, and a sample position at which the X-ray beam is directed.

Such an X-ray apparatus is known from U.S. Pat. No. 7,929,667 B1.

By means of X-rays, samples may be investigated in a destruction-free and efficient manner. X-rays may interact with a sample in numerous ways in order to obtain analytical information about the sample, with X-ray diffraction (XRD) and X-ray fluorescence (XRF) being two important methods. In general, high X-ray intensities are useful to obtain high signal to noise ratios in X-ray analysis experiments.

X-rays are typically generated by directing an electron beam onto a target. The deceleration of the beam electrons (resulting in Bremsstrahlung) as well as the refilling of depleted deep electron shells of the target material (resulting in characteristic X-rays) leads to X-ray emissions within the focal spot of the electron beam on the target. In order to provide X-rays of a particular wavelength, monochromators may be used. Further, if the sample is significantly spaced apart from the focal spot, it is useful to focus X-rays by suitable optics such as Göbel mirrors or Montel optics.

U.S. Pat. No. 6,249,566 B1 proposes to combine a microfocus X-ray source with Montel type optics to focus X-rays onto a sample. Apparent focal spot sizes of about 30 μm or less are proposed.

A particular high brightness X-ray source has been proposed in U.S. Pat. No. 7,929,667 B1, wherein an electron beam is focused on a jet of liquid metal, such as gallium. Higher power loads on the target due to the electron beam and thus high brightness levels are possible as the target is already liquid and can dissipate quickly the generated heat from the focal spot. A multilayer X-ray focusing element may be used to shape an X-ray beam. Focal spot sizes of about 10-15 μm are mentioned.

U.S. Pat. No. 6,711,233 B2 also proposes an X-ray source wherein an electron beam is directed onto a liquid metal jet target. It is proposed to match the size of the electron beam with the size of the jet, with the jet having a diameter of about 1-100 μM.

When combining a microfocus X-ray source with X-ray optics, it is necessary to align these components with respect to each other. Alignment in this sense means that a certain aspect of the beam properties downstream the mirror is maximized. Depending on the aimed application this aspects can for example be flux density or integral flux. In classical x-ray systems this is achieved by changing the x-ray optics and mechanically repositioning the x-ray optics. However, mechanically moving the X-ray optics on the μm range to match the focal spot of the X-ray source with the focus of the X-ray optics is difficult in practice, in particular due to backlash of alignment mechanics.

It is the object of the invention to provide an X-ray apparatus wherein aligning the X-ray optics with respect to a microfocus X-ray source is simplified.

SUMMARY OF THE INVENTION

This object is achieved, in accordance with the invention, by an X-ray apparatus as mentioned in the beginning, characterized in that the X-ray apparatus further comprises an electrostatic or electromagnetic electron beam deflection device, suitable for moving the focal spot on the target, and in that in any direction the extension of the focal spot is smaller at least by a factor F, with F=1.5, than the extension of the target.

By means of the electron beam deflection device, the focal spot can be moved on the target. The X-ray apparatus is aligned when the focal spot of the electron beam on the target overlaps the focus of the x-ray optics. Instead of mechanically moving the X-ray optics, the inventive apparatus allows moving the focal spot, what can conveniently be done with electric means (such as changing the voltage between electrodes or changing an electric current through an electromagnetic coil), in particular without using alignment mechanics. An electric alignment is highly reproducible, allows a higher precision, and is in particular not subject to backlash effects. Accordingly, the inventive apparatus can be aligned in a fast and simple way.

In accordance with the invention, the focal spot has a size (extension) S with $S*F \leq T$, with F=1.5 and T being the size (extension) of the target; this equation is valid in any direction (i.e. S and T are measured in the same direction, but this direction can be chosen arbitrarily; further below SX, SY, SZ and TX, TY, TZ as the sizes of the focal spot and the target in directions x, y, z are discussed in more detail). This means that the focal spot has a minimum available alignment range in any direction without leaving the target. This requirement ensures that, after a coarse prealignment of the target and the X-ray optics by mechanical means, a fine alignment via the electron beam deflection device is easily feasible.

The extension of the focal spot (and the electron beam) may be determined as the full width at half maximum (FWHM) of the electron intensity distribution. The extension of the X-ray beam may be determined as the full width at half maximum of the photon intensity distribution. It should be noted that the electron beam deflection device may be included in the electron beam source (then the electron beam source needs control inputs for adjusting the beam deflection), but typically is separate from the electron beam source. The electron beam has a (maximum) diameter small enough to qualify for a microfocus X-ray source, such as 100 μm or less, preferably 30 μm or less.

The X-ray apparatus is typically an X-ray analysis apparatus, with a sample to be analyzed (typically a single crystal sample, thin film sample, or a powder sample) being located at the sample position. A typical X-ray measurement to be done with an inventive X-ray apparatus is X-ray diffraction (XRD), in particular single-crystal X-ray diffraction, high resolution thin film analysis, grazing incidence diffraction, microdiffraction as well as (grazing incidence) small-angle scattering.

In a preferred embodiment of the inventive apparatus, the target is a liquid metal jet target. This allows a particularly high brilliance. The target material at the focal spot is continuously replaced, what avoids a local overheating (e.g.

evaporation) of the target. Further, the jet is a simple way to provide a curved target surface (see below), typically with a circular curvature.

Preferred is a further development of this embodiment, wherein in a direction transverse to the liquid metal jet target propagation direction and transverse to the propagation direction of the electron beam, the extension of the focal spot is smaller at least by a factor FT, with FT=2, preferably FT=5, than the extension of the liquid metal jet target. This increases the available alignment range of the focal spot on the target. Further, a curvature of the target has a stronger effect on the apparent spot size and the self-absorption of the target.

In a highly particularly preferred embodiment, the target has a curved surface, in particular having a radius of curvature R, with $0<R\leq 10$ mm, preferably with $0<R\leq 1$ mm. The curved surface allows an adjustment of the apparent spot size of the focal spot by moving the focal spot on the target. When the electron beam hits the target surface perpendicularly or almost perpendicularly, an X-ray beam emitted at about 90° with respect to the electron beam will appear to have a small focal spot (small apparent spot size). On the other hand, when the electron beam hits the target surface at a flat or even at an almost tangential angle, an X-ray beam emitted at 90° with respect to the electron beam will appear to have a large focal spot (large apparent spot size); however the latter X-ray beam will experience less self-absorption. Note that the target may have parts with a non-curved surface, too, in accordance with this embodiment. At least a part of the curved surface of the target faces the electron beam source, such that the focal spot may be moved across said part. Note that the radius of curvature may change in said part.

In a further development of this embodiment, the electron beam deflection device is suitable for moving the focal spot on the target in a plane in which the target surface is curved. Then the adjustment of the focal spot size via the target can be done particularly simple in an electrical way.

Particularly preferred is an embodiment, wherein the X-ray apparatus further comprises an electrostatic or electromagnetic electron beam focusing device, suitable for changing the spot area of the focal spot at least by a factor FS, with FS=2, preferably FS=5. The electron beam focusing device allows a widening and narrowing of the focal spot on the target. By this means, further characteristics of the resulting X-ray beam may be adjusted, such as the size, shape, divergence or (integral) intensity, without changing the e-beam power. It should be noted that the electron beam focussing device may be included in the electron beam source (then the electron beam source needs control inputs for adjusting the beam focusing), but typically is separate from the electron beam source. The electron beam focussing device may be integrated with the electron beam deflection device.

In a preferred further development of this embodiment, the electron beam focusing device comprises one or more electromagnetic coils and/or one or more charged electrodes. These simple elements have shown good results in practice. The electron movement may be influenced via magnetic fields generated by the coils or electric fields at the electrodes.

Further preferred is an embodiment wherein the electron beam deflection device is suitable for moving the focal spot on the target by at least a distance D, with D=50 μm, preferably D=200 μm. These ranges are typically well suited for both a simple relative alignment of the target and the electron beam, and for adjusting the apparent spot size at a curved target surface.

In an advantageous embodiment, the electron beam deflection device is suitable for deflecting the electron beam in two independent directions perpendicular to a propagation direction of the electron beam, in particular wherein said two independent directions are perpendicular to each other. Two linear independent movement directions give access to an area of alignment on the target. Perpendicular orientation of the independent directions simplifies accessing a particular spot on the target.

Further preferred is an embodiment wherein the electron beam deflection device comprises one or more electromagnetic coils and/or a one or more charged electrodes. These simple elements have shown good results in practice. The electron movement may be influenced via magnetic fields generated by the coils or electric fields at the electrodes.

Particularly preferred is an embodiment wherein the X-ray optics comprises a multilayer mirror, in particular a Montel mirror or a Göbel mirror or a mirror having a single reflective surface curved with respect to both a sagittal and a meridional direction of incident X-rays, and/or capillary X-ray optics. These elements allow an accurate focusing or collimation of X-rays, proven in practice. In particular, the X-ray optics may comprise a double curved mirror as described in U.S. Pat. No. 7,248,670 B2.

In a preferred embodiment, the factor F=2, preferably F=5. This increases the available alignment range of the focal spot on the target. Further, a curvature of the target has a stronger effect on the apparent spot size and the self-absorption of the target.

Preferred is further an embodiment wherein the X-ray optics is positioned to collect X-rays emitted from the focal spot at essentially 90° with respect to a propagation direction of the electron beam hitting the target. In this orientation, high X-ray intensity levels can be obtained, and spot size adjustment via a curved target surface works well. The X-ray optics are typically arranged at an angle of (and including) 85° through 95° with respect to the electron beam, and use X-rays from an angle interval of 10° or less, typically 5° or less.

Further within the scope of the present invention is a method for aligning an X-ray apparatus, in particular an inventive X-ray apparatus as described above, wherein the apparatus comprises an electron beam source, emitting an electron beam, a target, onto which the electron beam is directed, thus forming a focal spot on the target, X-ray optics, collecting X-rays from a focus of the X-ray optics, characterized in that the focal spot is moved on the target by deflecting the electron beam by means of an electric and/or magnetic field until the focal spot overlaps with the focus of the X-ray optics. After a coarse mechanical prealignment, this fine alignment is simple to perform by electric means, is highly reproducible and precise and not subject to mechanical backlashes. Typically the fine alignment includes iteratively or continuously changing the focal spot position while simultaneously monitoring the photon flux at a detector arranged downstream (after) the X-ray optics.

Also within the scope of the present invention is a method for aligning an X-ray apparatus, in particular an inventive X-ray apparatus as described above, wherein the apparatus comprises an electron beam source, emitting an electron beam, a target, onto which the electron beam is directed, thus forming a focal spot on the target, X-ray optics, collecting X-rays from a focus of the X-ray optics, characterized in that the focal spot is moved on the target by deflecting the electron beam by means of an electric and/or magnetic field, and/or the spot area of the focal spot is changed by changing the focusing of the electron beam by means of an electric and/or magnetic field, until the photon flux or the photon flux density of an X-ray beam formed by the X-ray optics is maximized. Again, this alignment is simple to perform by electric means and is highly reproducible Typically the alignment includes iteratively or continuously changing the focal spot position. The photon flux density may, for example, be measured at a sample position or a detector position downstream the X-ray optics. If the X-ray optics is of focusing type, the photon flux density is the optimization parameter and is typically measured at the image focus (second focus) of the X-ray optics. If the X-ray optics is of collimating type, the photon flux per solid angle is the optimization parameter wherein the divergence and flux can be measured anywhere downstream the X-ray optics. It should be noted that within the inventive methods mentioned above, the extension of the focal spot is typically always smaller at least by a factor F, with F=1.5, preferably F=2, most preferably F=5, than the extension of the target in any direction.

In a preferred variant of this latter inventive method, the apparatus is switched between two operation modes wherein in a first of the operation modes the photon flux is maximized, and wherein in a second of the operation modes the photon flux density is maximized. By changing the operation modes, the apparatus may be adapted to dedicated analysis measurements without the need to change the X-ray optics. Thus, this inventive method is very time-saving and cost-saving. With the photon flux density being maximized, diffraction data from a limited local area may be well obtained. With the photon flux maximized, diffraction data may be obtained with a high signal to noise ratio in short time. The change of operation modes may in particular be done by moving the focal spot on a curved target surface to a different position.

In an advantageous further development, the target of the apparatus is chosen as a target with a curved surface having a radius of curvature R, with $0<R\leq 1$ mm. This simplifies changing the operation modes by moving the focal spot on the target.

Further advantages can be extracted from the description and the enclosed drawing. The features mentioned above and below can be used in accordance with the invention either individually or collectively in any combination. The embodiments mentioned are not to be understood as exhaustive enumeration but rather have exemplary character for the description of the invention.

The invention is shown in the drawing.

DESCRIPTION OF THE PREFERRED EMBODIMENT

Overview of the Invention

The invention proposes an X-ray apparatus with an X-ray source, in particular a microfocus X-ray source, which allows for a continuous variation of the position of the electron beam on the target, in particular a liquid metal jet target, preferably in two directions. In other words, the position of the focal spot of the electron beam is variable. To alter the spot position, the electron beam can be deflected by applying an electric and/or magnetic field to the electron beam.

As an advantage of the variable spot position, it is possible to align the X-ray source and a subsequent X-ray optics in a fast and comfortable way. In the state of the art, the alignment is done only mechanically. Due to the backlash of the mechanics in and/or at the optics housing it is difficult and time consuming to optimize the alignment (which is done by increasing the photon flux of the primary beam). However, by varying the spot position on the target, the relative position of the X-ray optics and the focal spot can be changed and thus optimized, in particular such that the photon flux or the photon flux density is maximized. As the spot position is not varied mechanically, but electromagnetically via electrodes or coils (e.g. in the source), this alignment procedure is very reproducible with an accuracy in the μm-range.

Preferably, the target has a curved surface, for example wherein the target is of liquid metal jet type, what is preferred for the invention. By moving the electron beam perpendicular to the flow direction of the jet, the projected size of the X-ray emission area can be changed continuously.

A combination of said microfocus X-ray source with curved (in particular elliptical or parabolic shape) multilayer mirrors allows to tailor the size, shape, divergence and intensity of the X-ray beam at the sample position. These properties of the X-ray beam may be changed continuously, allowing to adapt the X-ray beam to the needs of the experiment without the need of swapping optics. The optimization of the X-ray beam properties further results in an improved data quality and a shortened measurement time.

When the electron beam is positioned close to the center position of the jet, the take-off angle of the X-ray beam is small, and X-ray self-absorption in the target is high, resulting in a small apparent source size with reduced integral flux, but increased flux density ("flux density maximization"). This small FWHM size of the X-ray source is the optimum X-ray beam condition for analyzing small samples; using focusing optics most of the photons are in the center of the X-ray beam hitting the small sample. By this, a diffracted intensity from the sample is maximized and the background noise is reduced, as the amount of photons that do not hit the sample, but just contribute to the background noise, is low.

Figure 6:
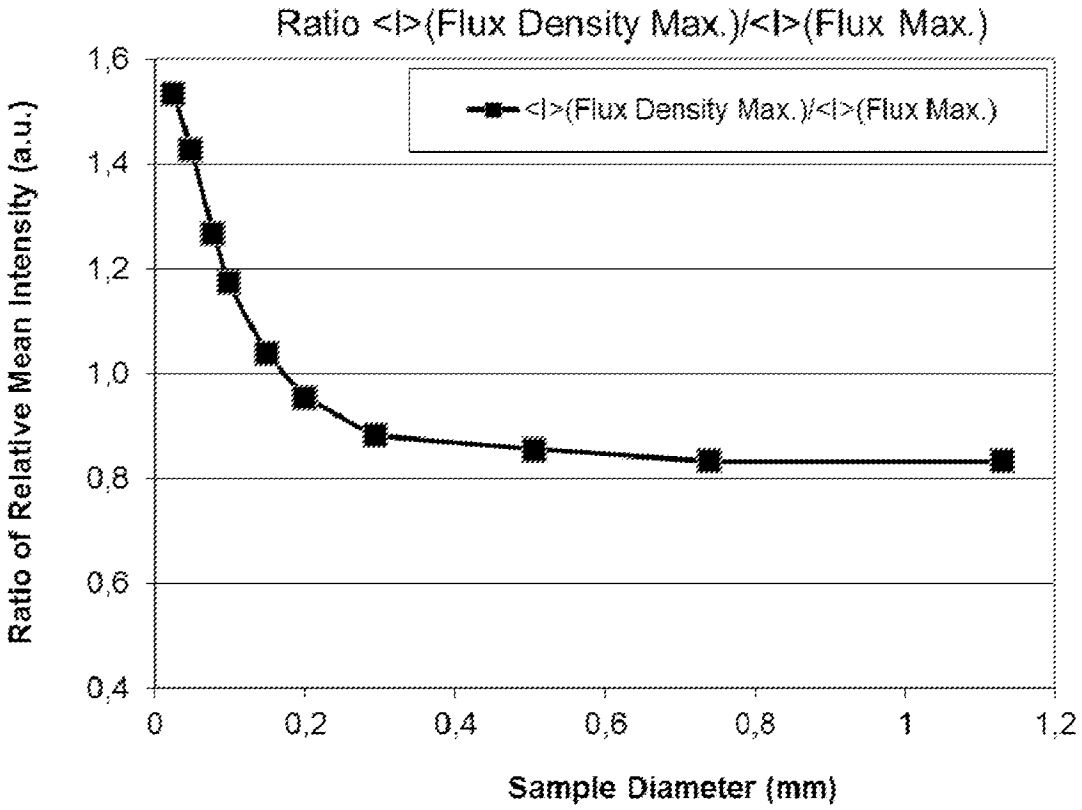
FIG. 6 shows a diagram illustrating the ratio of mean X-ray intensities at alignment positions with the flux density maximized and the flux maximized, for different sample sizes, measured on an inventive X-ray apparatus.

When shifting the electron beam away from the center towards the edge of the liquid metal jet target, the take-off angle is increased, enlarging the apparent spot size and reducing the self-absorption in the metal jet target. Consequently, using focusing optics the FWHM of the X-ray beam is increased and the peak intensity (flux density) is decreased ("Flux maximization"). Compared to the flux density maximization, the integral flux is now increased, as the self-absorption of the generated X-ray photons in the jet is reduced by placing the electron beam closer to the edge of the jet. This is the optimum condition for analyzing larger samples. It should be noted that by changing the position of a typical focal spot on a typical jet, the integral intensity can be changed by about 20%, and the flux density can be changed by about 50% with ease, compare FIG. 6. For this diagram, at different sample sizes, the flux and the flux density were maximized each, and the ratio of the mean fluxes incident on the respective sample diameter was determined at these alignment positions. According to the results, depending on the sample diameter used in the respective experiment, either a flux density or a flux optimized alignment is preferable.

Preferably, the inventive X-ray apparatus is further capable of changing the size of the focal spot of the electron beam on the target by changing the focusing of the electron beam ("variable spot size"). In other words, the electron beam is widened or narrowed by electromagnetic means. This way the (microfocus) X-ray source is capable of changing the e-beam spot size on the metal jet target. It was found that the electron power density can be increased when the e-beam spot size decreases, without overheating the target. This can be used to increase the photon flux density, at the expense of integral photon flux. Small e-beam spots will result in small apparent X-ray spot sizes, advantageous for smaller samples, while larger e-beam spots will allow larger X-ray spot sizes at higher X-ray flux, advantageous for larger samples. Together with X-ray optics, this enables the system to control the size of the X-ray spot size on the sample position, the divergence of the X-ray beam and the integral flux downstream the X-ray optics.

Description of Inventive Experimental Setups Shown in the Figures

Figure 1A:
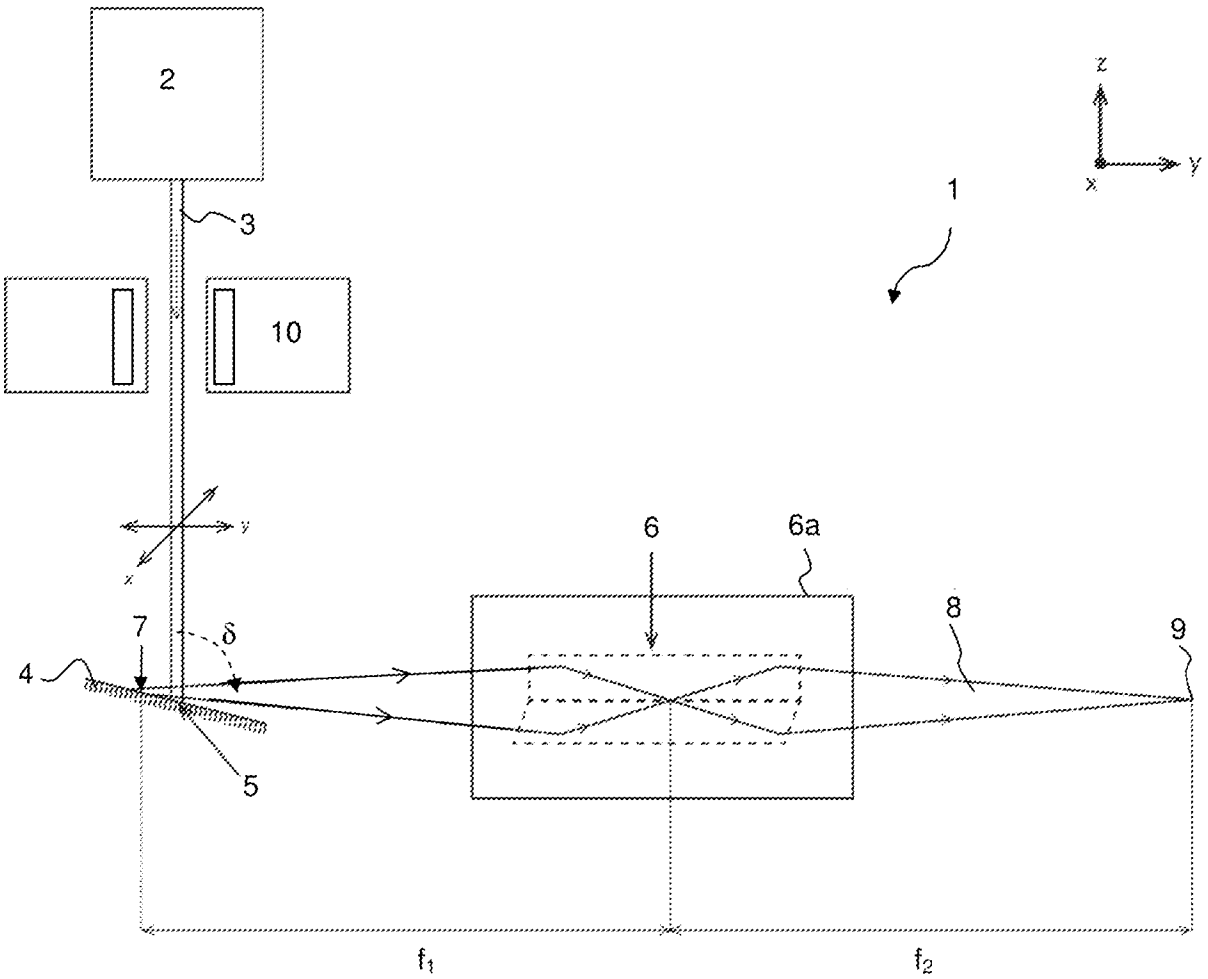
FIG. 1*a* shows schematically an embodiment of an inventive X-ray apparatus, with an electron beam deflection device for moving a focal spot of an electron beam on a flat target, with an undeflected electron beam.

FIG. 1*a* shows schematically an embodiment of an inventive X-ray apparatus 1. An electron beam source 2 emits an electron beam 3. The electron beam 3 hits a target 4, here of a solid and flat type. A typical solid target material for use with the invention is copper. The area where the electron beam 3 hits the target 4 is called a focal spot 5. At the focal spot 5, X-rays are generated.

X-ray optics 6, here of Montel type with two graded multilayer mirrors in a side by side orthogonal configuration, within an optic housing 6*a*, collect X-rays from a focus 7 of the X-ray optics 6 (compare focal length $f_1$ on the entry side) and its close vicinity, thus forming an X-ray beam 8 directed to a sample position 9, where a sample to be investigated (not shown) is located. Note that the X-rays are collected at an angle δ of about 90° with respect to the electron beam propagation direction (here negative z). Beyond the sample position 9, an X-ray detector (not shown) is located. In the example shown, the X-ray beam 8 is focused at the sample position 9 (compare focal length $f_2$ on the exit side); however it is also possible to parallelize (or otherwise shape) the X-ray beam 8 by means of the X-ray optics 6, in accordance with the invention.

In the configuration shown, with the electron beam 3 being undeflected (i.e. propagating linearly), the focus 7 of the X-ray optics 6 deviates slightly from the focal spot 5 of the electron beam 3. Accordingly, only a small percentage of the X-rays generated at the target 4 or its focal spot 5, respectively, is collected by the X-ray optics 6.

In order to increase the percentage of collected X-rays, the electron beam 3 may be deflected by means of an electron beam deflection device 10, here comprising a pair of charged electrodes (alternatively or in addition, the electron beam can be deflected by a magnetic field, generated by an electromagnetic coil). The deflection device 10 can deflect (shift) the electron beam 3 continuously in two orthogonal directions x, y perpendicular to its propagation direction z by adjusting a control voltage at the electrodes (or alternatively or in addition, adjusting a current at electromagnetic coils). In the embodiment shown, the defection device 10 is separate from the electron beam source 2; however, the deflection device 10 may also be integrated into the electron beam source 2.

Figure 1B:
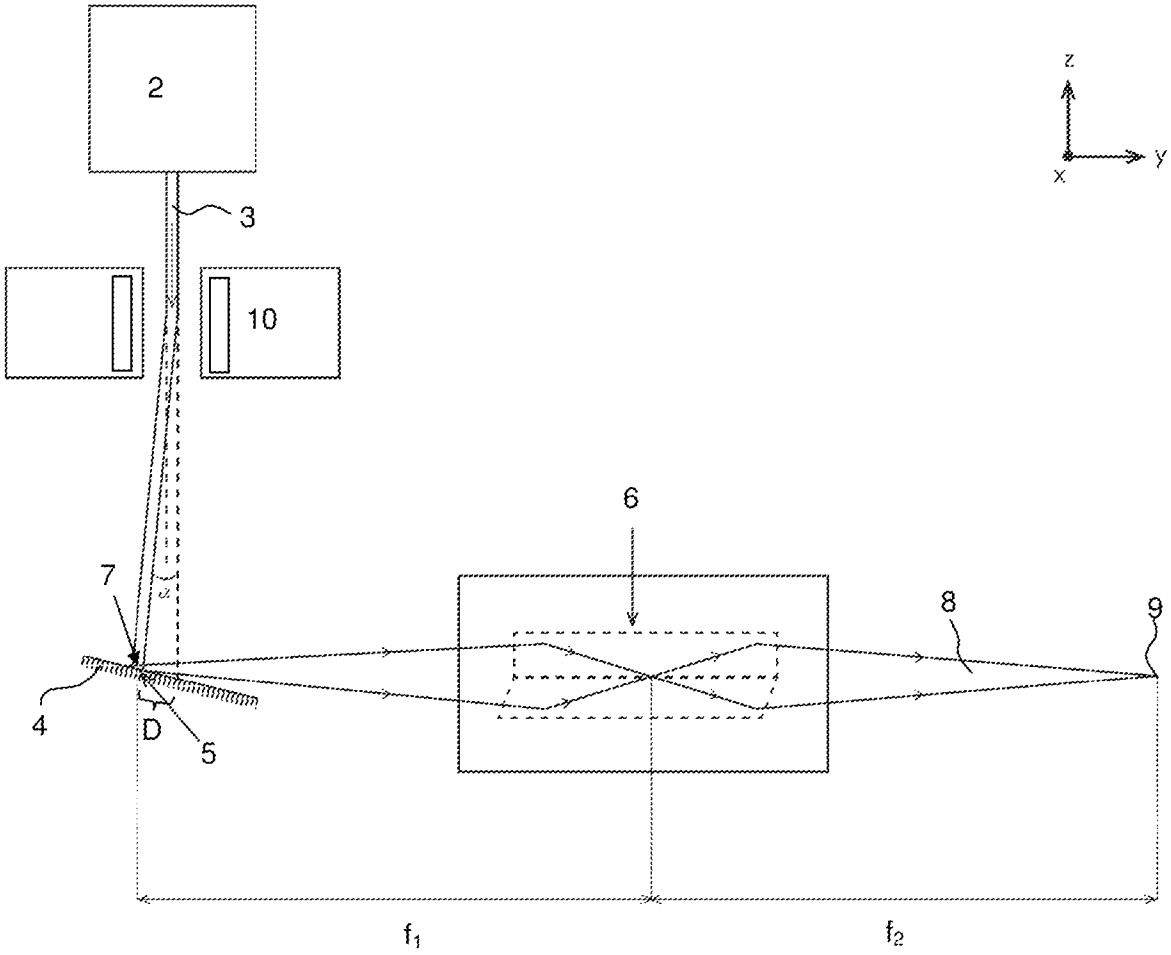
FIG. 1*b* shows the embodiment of FIG. 1*a*, with deflected electron beam.

In FIG. 1*b*, the electron beam deflection device 10 has been activated in order to move the focal spot 5 on the target 4. After proper adjustment of the deflection device 10, namely slightly moving the focal spot 5 over a distance D basically in negative y direction or deflecting the electron beam 3 by a small angle α to the right, respectively, the focal spot 5 overlaps with the focus 7 of the X-ray optics 6. Thus a high percentage of the X-rays generated at the focal spot 5 may be collected by the X-ray optics 6 and directed to the sample position 9. Note that the optimum position of the focal spot 5 is typically found by maximizing the photon flux or the photon flux density downstream the X-ray optics 6, such as at the sample position.

It should be noted that the width of the electron beam as well as the width of the X-ray beam is shown enlarged in the figures, in order to increase comprehensibility. A typical distance D over which the focal spot 5 can be moved on the target 4 is about 200 μm.

Figure 1C:
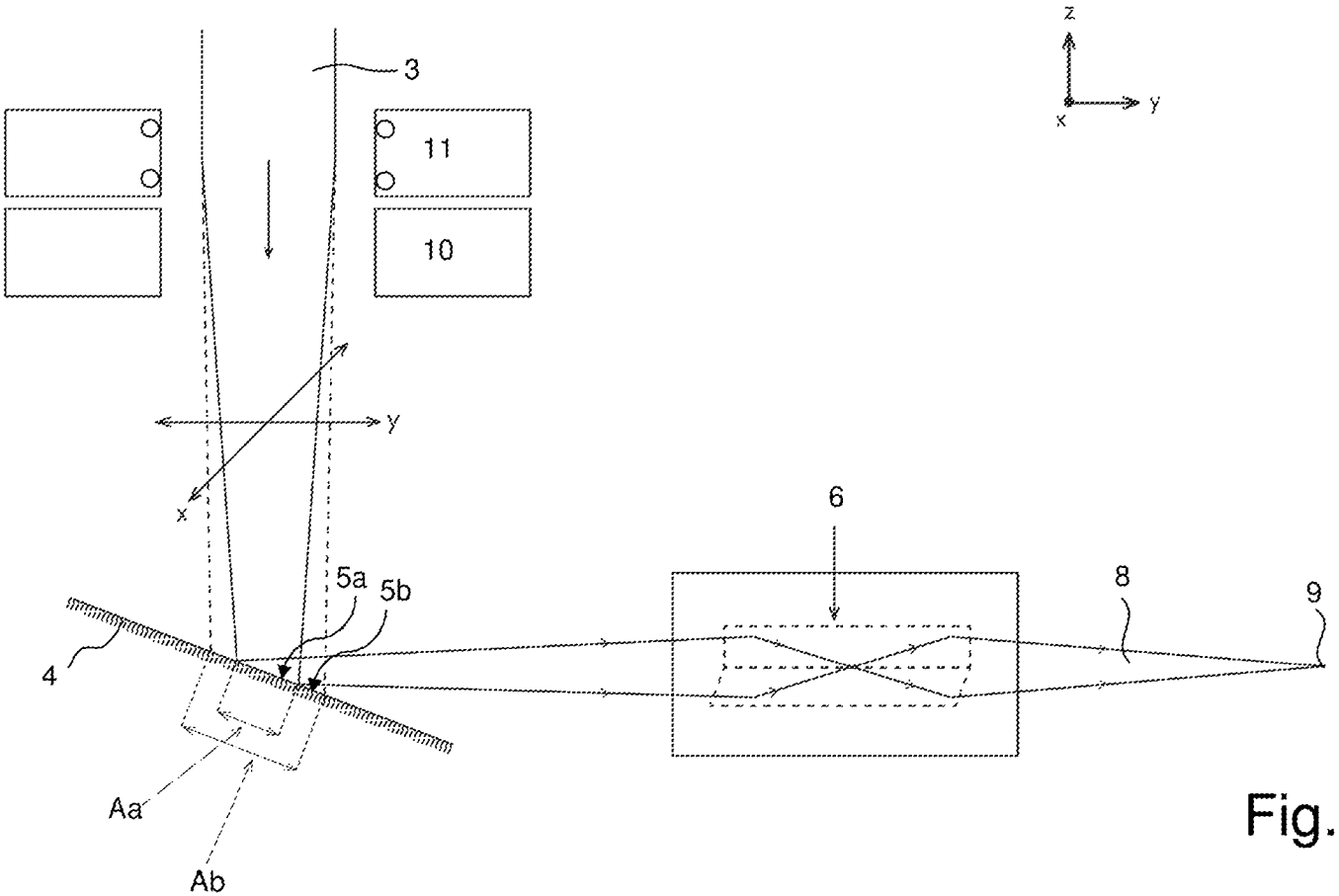
FIG. 1*c* shows schematically a second embodiment of an inventive X-ray apparatus, with an additional electron beam focusing device for adjusting the size of the focal spot.

FIG. 1*c* illustrates a variant of the embodiment of the X-ray apparatus 1 of FIG. 1*a*, but comprising an electron beam focusing device 11 (here comprising an electromagnetic coil assembly) in addition to the deflection device 10. Note that the focusing device 11 may be integrated into the deflection device 10 and/or into the electron beam source 2, if desired. The electron beam focusing device 11 allows to change the focusing of the electron beam 3, i.e. the width of the electron beam 3 on the target 4, by changing the electric currents through the coils of the coil assembly. By this means, the area of the focal spot can be adjusted directly.

In the figure, the solid lines of the strongly narrowing electron beam 3 belong to a focal spot 5*a* with a small focal spot area Aa, whereas the dashed lines of the electron beam 3 only slightly narrowing belong to a focal spot 5*b* with a rather large focal spot area Ab; note that the areas Aa, Ab are shown in a projection each. Typically, the focusing device 11 allows an area change by a factor of up to five. By altering the focusing of the electron beam 3, some properties of the X-ray beam 8 at the sample position 9 can be altered, such as the beam divergence or the integral photon flux, without changing the electron beam power.

Figures 2A, 2B:
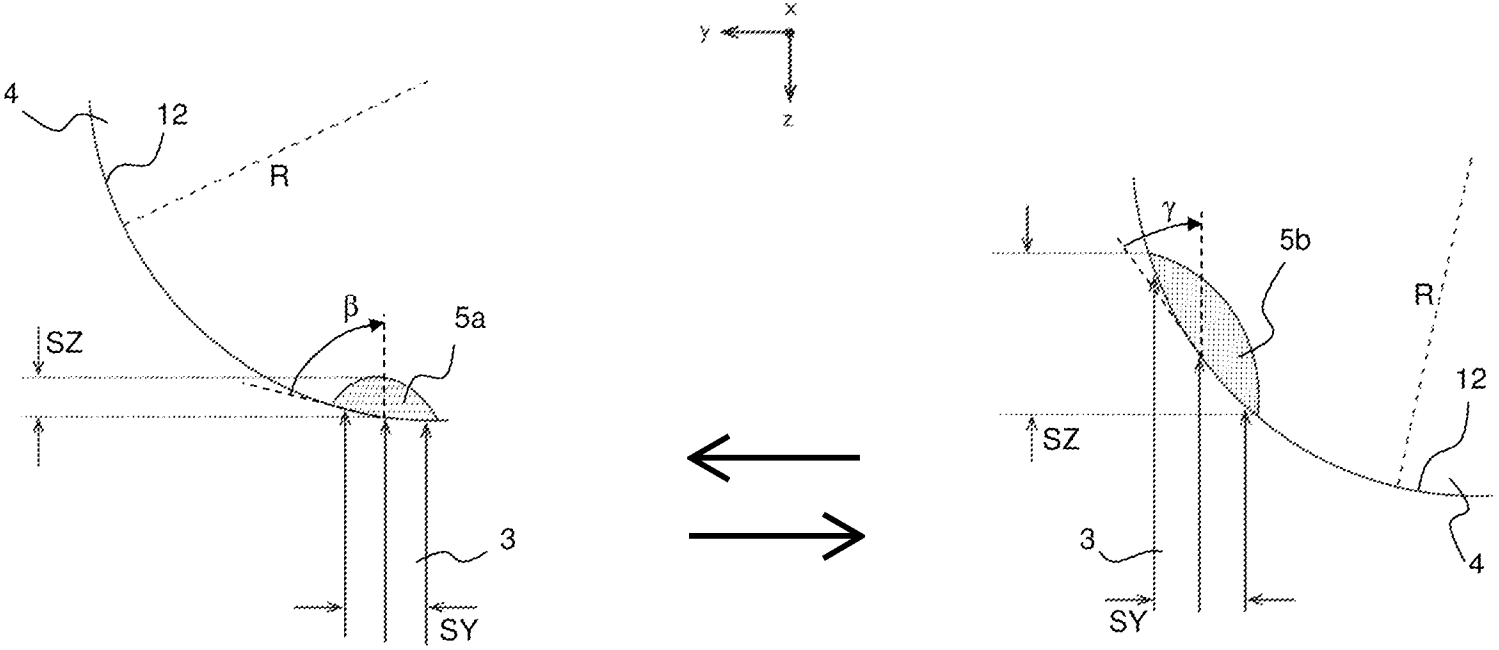
FIG. 2*a* shows a schematic cross section of a curved target, hit basically perpendicularly by an electron beam much narrower than the target.
FIG. 2*b* shows a schematic cross section of the curved target of FIG. 2*a*, hit at a flat angle by the electron beam.

FIGS. 2*a* and 2*b* illustrate focal spots 5*a*, 5*b* on a curved target 4 for an electron beam 3 for different positions of the focal spots 5*a*, 5*b* on the target 4. The figures show cross-sections through the target 4, here a circular liquid metal jet propagating in the x direction with a radius of curvature R, in a plane (yz-plane) including the electron beam propagation direction (negative z) and perpendicular to the jet propagation direction x. In this plane, the target surface 12 is curved. The electron beam 3 can be moved at least within this plane, i.e. here basically in y direction.

If the electron beam 3 hits the target 4 basically perpendicular to the curved target surface 12 (compare angle β of about 80°), as shown in FIG. 2*a*, the apparent focal spot size SZ in z direction is rather small, in particular smaller than the focal spot size SY in y direction. Since the X-rays originate from a small area, a high photon flux density can be achieved. On the other hand, if the electron beam 3 hits the curved target surface 12 under a relatively flat angle (compare angle γ of about 35°), as shown in FIG. 2*b*, the apparent focal spot size SZ in z direction is rather large, in particular larger than the focal spot size SY in y direction.

In the configuration of FIG. 2*a*, with a small focal spot size SZ in z direction, self-absorption of X-rays is rather large when the X-ray beam is taken on the left side in y direction (i.e. perpendicular to the electron beam propagation direction): X-rays generated on the right hand side of the focal spot 5*a* have to pass much target material before leaving the target 4. In contrast, in the configuration of FIG. 2*b*, with a large focal spot size SZ in z direction, self-absorption is relatively weak: Even X-rays generated on the right hand side of the focal spot 5*b* have to pass only few target material before leaving the target 4. Accordingly, the latter configuration yields a high integral photon flux.

Preferably, an inventive X-ray apparatus is switchable between the two configurations of FIG. 2*a* and FIG. 2*b* electrically, for a quick change of X-ray beam characteristics between different measurements. Towards this end, a switching element (schematically indicated in the drawing of FIGS. 2*a* and 2*b* with a double arrow) is disposed, structured and dimensioned to switch the apparatus between two operation modes. In the first operation mode, the photon flux is maximized and in the second operation mode, a photon flux density is maximized.

In the example shown, the diameter 2*R of the target 4 (representing its extension both in y and z) is more than a factor F of F=5 larger than both SY and SZ for the two shown configurations.

Figure 3A:
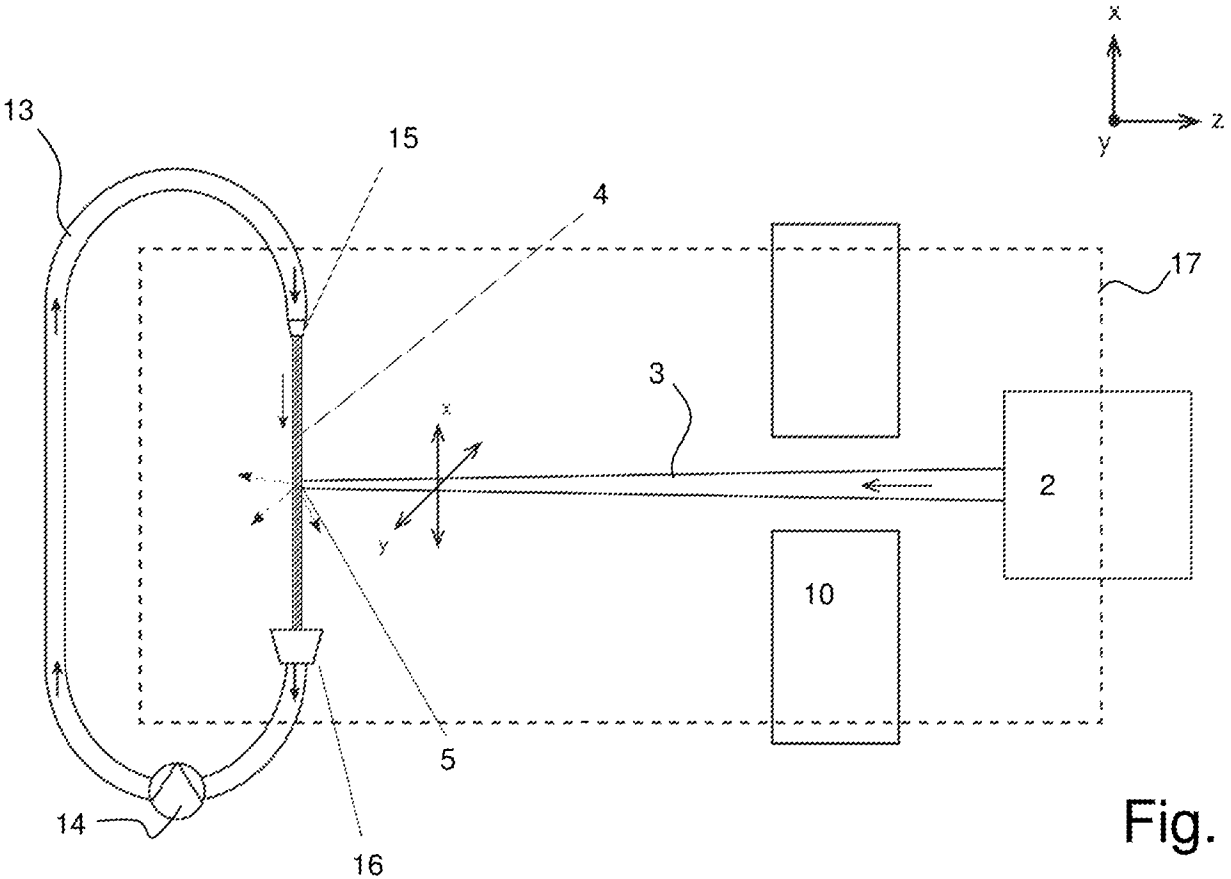
FIG. 3*a* shows a schematic drawing of parts of an inventive X-ray apparatus, with a liquid metal jet target.

FIG. 3*a* shows schematically parts of an embodiment of an inventive X-ray apparatus 1, wherein the electron beam 3 emitted by an electron beam source 2 passes through an electron beam deflection device 10 (or a combined electron beam deflection and focusing device), suitable for deflecting the electron beam 3 in x and y direction, and hits a liquid metal jet target 4 at a focal spot 5 where X-rays are generated.

A continuous stream of liquid metal (for example consisting of gallium) is pumped through a circuit 13 by means of a pump 14 and directed via a nozzle 15 into a funnel type recovery unit 16; between the nozzle 15 and the recovery unit 16, the free metal stream constitutes the jet type target 4. If needed, the circuit 13 includes a tempering stage for heating and/or cooling the metal within the circuit 13 (not shown). Note that the jet has typically a diameter of about 50-250 μm, whereas the electron beam diameter is typically 100 μm or less. Marked with a dashed box are the parts of the X-ray apparatus 1 which should be located in a vacuum chamber 17; in particular, the electron beam 3 should only propagate inside the vacuum chamber 17.

Figure 3B:
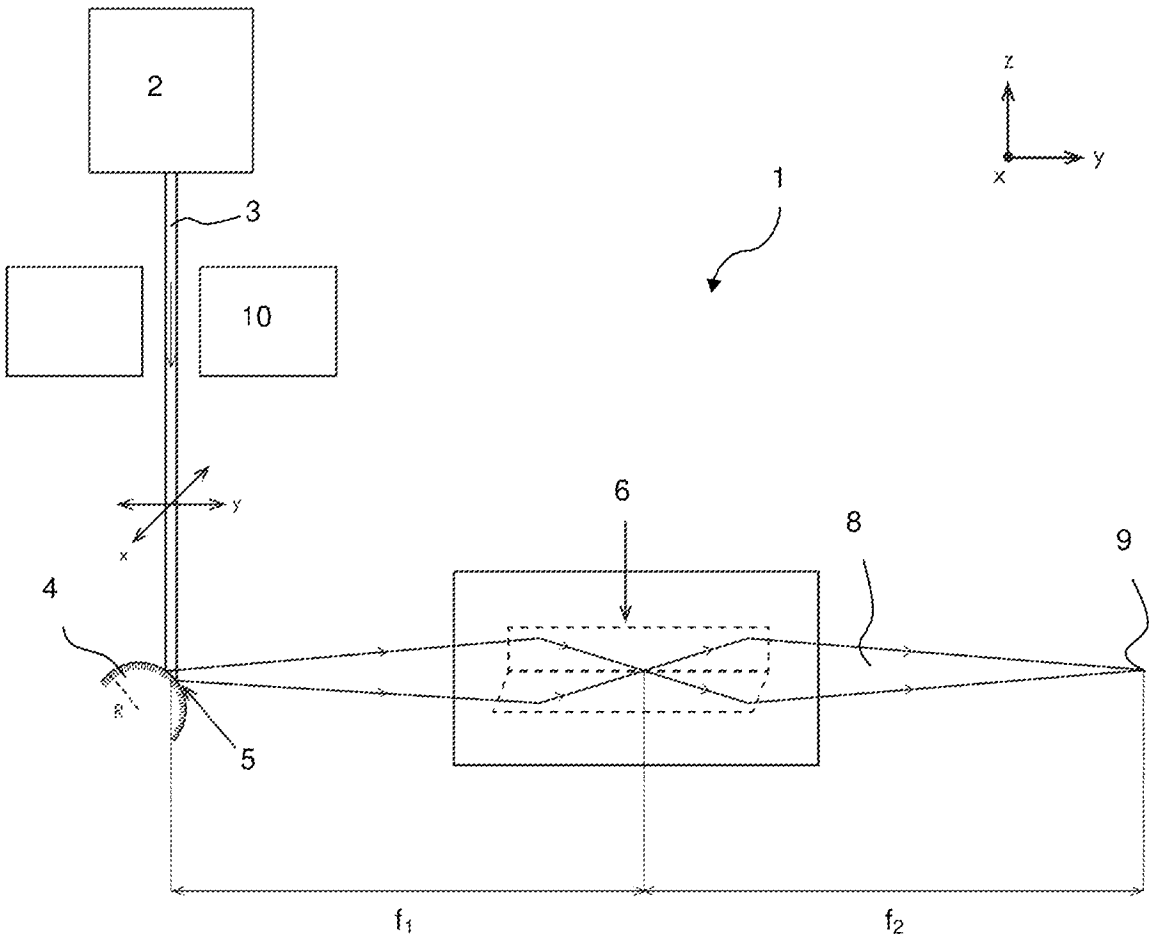
FIG. 3*b* shows schematically another embodiment of an inventive X-ray device, with an electron beam deflection device for moving a focal spot of an electron beam on a curved target.

FIG. 3*b* illustrates an embodiment of an inventive X-ray apparatus 1 similar to the one shown in FIG. 1*a*, but with a curved target 4, namely a liquid metal jet target 4 (as shown in FIG. 3*a*, for example). The jet propagates in x direction, i.e. perpendicular to the electron beam 3 and the X-ray beam 8. By means of the electron beam deflection device 10 (or a combined electron beam deflection and focusing device) the electron beam 3 can be deflected in x and y direction.

Figure 3C:
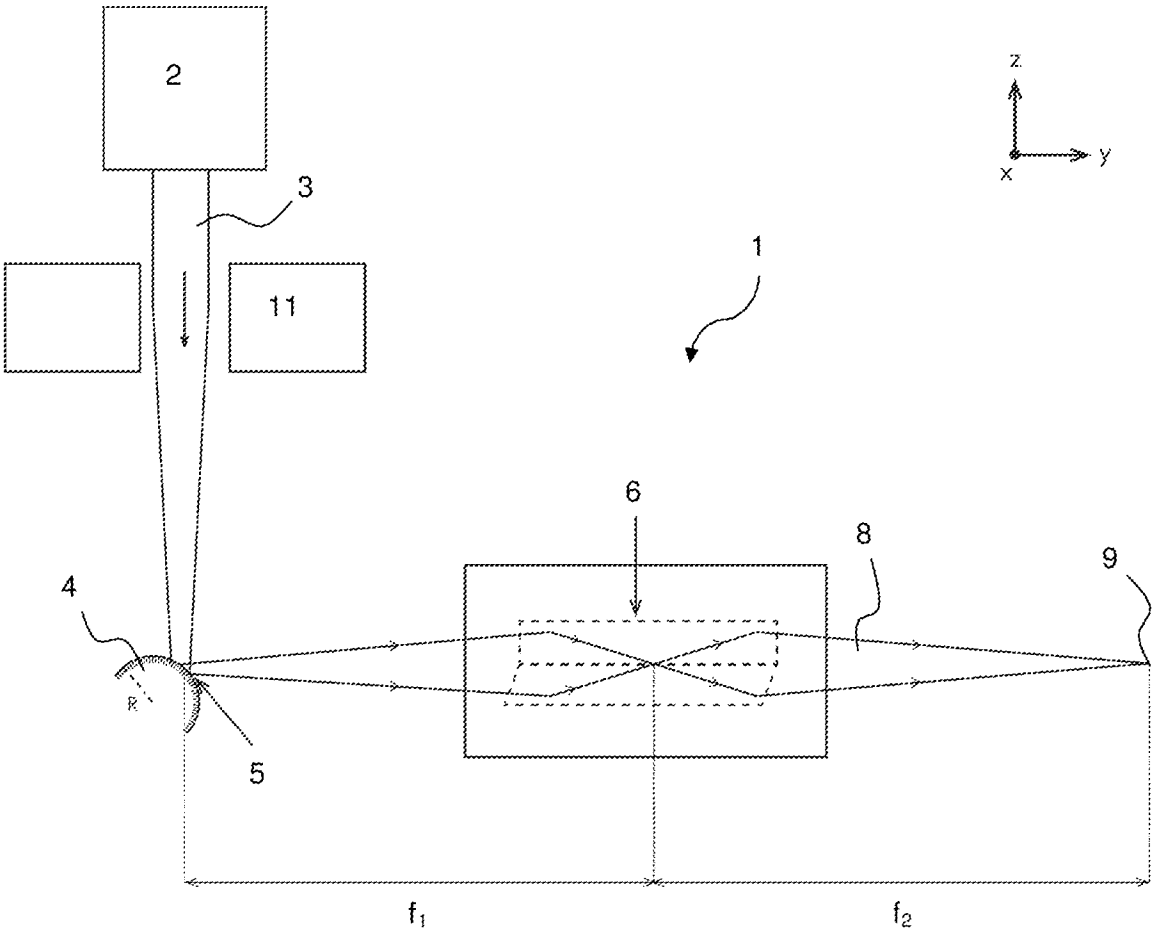
FIG. 3*c* shows schematically an X-ray device with an electron beam focusing device for adjusting the size of the focal spot on a curved target in accordance with the invention.

FIG. 3*c* shows an X-ray apparatus 1 also similar to the one shown in FIG. 1*a*, again with a liquid metal jet target 4. Here the size of the focal spot 5 can be changed by means of an electron beam focusing device 11. By changing the focal spot size (in x- and/or y-direction), the properties of the X-ray beam 8 downstream the X-ray optics 6 can be altered, in particular to obtain desired properties at the sample position 9. In particular, the properties of the X-ray beam 8 can be altered such that alternatively a maximum photon flux or a maximum photon flux density of the X-ray beam 8 can be obtained, in accordance with the invention.

Figure 4C:
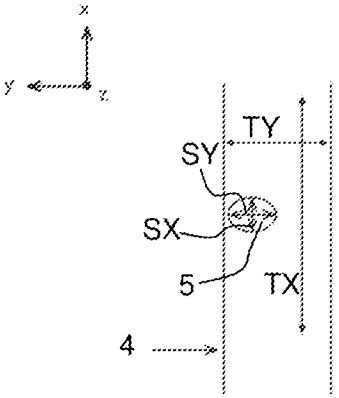
FIG. 4*c* shows schematically a front view of an ellipsoidal focal spot on a liquid metal jet target, in accordance with the invention.
Figure 4B:
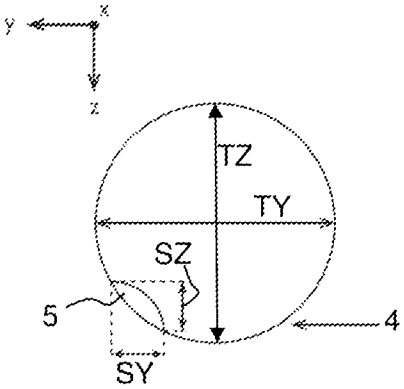
FIG. 4*b* shows schematically a cross-section of the target of FIG. 4*a* through the focal spot.
Figure 4A:
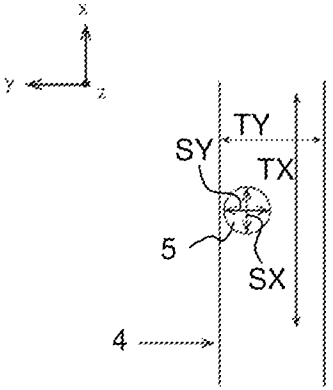
FIG. 4*a* shows schematically a front view of a circular focal spot on a liquid metal jet target, in accordance with the invention.

FIG. 4*a* and FIG. 4*b* illustrate in more detail a focal spot 5 of an electron beam on a target 4, here a liquid metal jet target, and their extension proportions in accordance with the invention. FIG. 4*a* shows a front view perpendicular to the z direction in which the electron beam propagates; FIG. 4*b* shows a cross-section in the plane perpendicular to the jet propagation direction x.

The size (or extension) SX of the focal spot 5 in x direction is here more than five times smaller than the size (or extension) TX of the target 4 in x direction (Note that typically, the jet is a some tens of mm in x direction, which is the direction in which the jet propagates). In the example shown, the size (or extension) SY of the focal spot 5 is about 3 times smaller than the size (or extension) TY of the target 4 in y direction. The size (or extension) SZ of the focal spot in z direction (resulting from the propagation depth of electrons in the target material) is about 5 times smaller than the size (or extension) TZ of the target 4 in z direction here. So all in all, for all directions (x, y, z), the size of the focal spot 5 is at least about a factor F, with F=3, times smaller than the size of the target 4. Note that in accordance with the invention, a factor F=1.5 is sufficient, but a factor F=2 is preferred, and a factor F=5 is particularly preferred.

FIG. 4*c* illustrates a focal spot 5 of elliptical shape. Here, too, the sizes SX, SY (and SZ, not shown) are at least about a factor F, with F=3, times smaller than the corresponding size TX, TY (and TZ, not shown) of the target 4. The target 4 is here of liquid metal jet type again. An elliptical electron beam may be the preferred choice because it can produce a circular "X-ray spot" (apparent focal spot) when viewed along the y direction (at an 90° angle with respect to the electron beam and the metal jet propagation direction);

towards this direction the X-ray optics is placed then, receiving an X-ray beam with circular cross-section.

Figure 5:
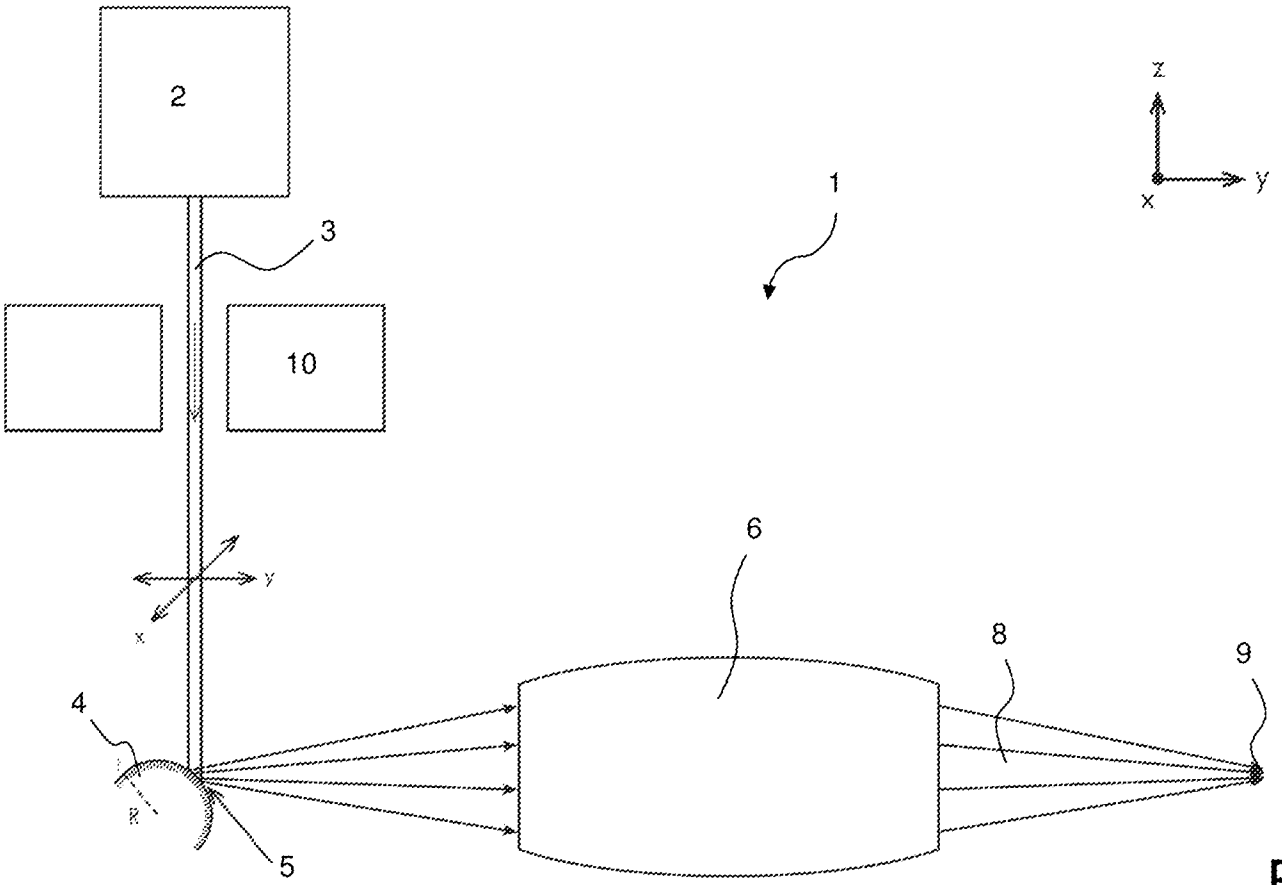
FIG. 5 shows schematically another embodiment of an inventive X-ray device, with capillary optics.

FIG. 5 illustrates another embodiment of an inventive X-ray apparatus 1, similar to the one shown in FIG. 1*a*, but with capillary optics used as X-ray optics 6 for directing the X-ray beam 8 to the sample position 9. The capillary optics include one or more hollow, bent tubes ("capillaries"), at the internal surfaces of which total reflection of the x-rays occurs, so the X-rays may be guided by means of the capillaries (not shown in detail). The target 4 is of liquid metal jet type.

In summary, the present invention proposes to align the focal spot of an electron beam and the focus of X-ray optics by deflecting the electron beam, thus allowing to do without mechanical fine alignment of the X-ray optics in an X-ray apparatus. Furthermore this invention allows to change the maximized X-ray beam properties downstream the X-ray optics by controlling shape and position of the focal spot on the target, in particular a target with a curved surface.

We claim:

1. An x-ray apparatus comprising:

an electron beam source, emitting an electron beam;

a target onto which the electron beam is directed, the electron beam thereby forming a focal spot on the target, wherein the target has a curved target surface;

x-ray optics having a focus and structured to collect x-rays emitted from the focal spot, thereby forming an x-ray beam;

a sample position to which the x-ray beam is directed;

an electrostatic or electromagnetic electron beam deflection device, the deflection device being disposed, structured and dimensioned to move the focal spot on the target in a plane in which the target surface is curved between a first position in which the electron beam is substantially perpendicular to the curved target surface and a second position in which the electron beam is incident on the curved target surface at a flat angle, the focal spot thereby having a size which is smaller at least by a factor F=1.5 than a size of the target, wherein, for the first position, a photon flux density is maximized and, for the second position, a photon flux is maximized.

2. The apparatus of claim 1, wherein the target is a liquid metal jet target.

3. The apparatus of claim 2, wherein, in a direction transverse to a liquid metal jet target propagation direction and transverse to a propagation direction of the electron beam, an extension of the focal spot is smaller at least by a factor FT=2 than an extension of the liquid metal jet target.

4. The apparatus of claim 3, wherein FT=5.

5. The apparatus of claim 1, wherein said curved surface has a radius of curvature R, with $0<R\leq 10$ mm or with $0<R\leq 1$ mm.

6. The apparatus of claim 1, further comprising an electrostatic or electromagnetic electron beam focusing device, suitable for changing a spot area of the focal spot at least by a factor FS=2 or FS=5.

7. The apparatus of claim 6, wherein the electron beam focusing device comprises one or more electromagnetic coils and/or one or more charged electrodes.

8. The apparatus of claim 1, wherein the electron beam deflection device is suitable for moving the focal spot on the target by at least a distance D=50 μm or D=200 μm.

9. The apparatus of claim 1, wherein the electron beam deflection device is suitable for deflecting the electron beam in two independent directions perpendicular to a propagation direction of the electron beam.

10. The apparatus of claim 9, wherein the independent directions are perpendicular to each other.

11. The apparatus of claim 1, wherein the electron beam deflection device comprises one or more electromagnetic coils and/or one or more charged electrodes.

12. The apparatus of claim 1, wherein the x-ray optics comprises a multilayer mirror, a Montel mirror, a Göbel mirror or mirror having a single reflective surface curved with respect to both a sagittal and a meridional direction of incident x-rays and/or capillary x-ray optics.

13. The apparatus of claim 1, wherein the factor F=2 or F=5.

14. The apparatus of claim 1, wherein the x-ray optics is positioned to collect x-rays emitted from the focal spot at essentially 90° with respect to a propagation direction of the electron beam hitting the target.

15. A method for aligning an x-ray apparatus, the x-ray apparatus having an electron beam source emitting an electron beam, a target onto which the electron beam is directed, thus forming a focal spot on that target and x-ray optics for collecting x-rays from a focus thereof, the method comprising the step of:

moving the focal spot on the target by deflecting the electron beam with an electric and/or magnetic field until the focal spot overlaps the focus of the x-ray optics.

16. A method for aligning an x-ray apparatus, the x-ray apparatus having an electron beam source emitting an electron beam, a target having a curved target surface onto which the electron beam is directed, thereby forming a focal spot on that target and x-ray optics for collecting x-rays from a focus of those x-ray optics, the method comprising the steps of:

a) directing the electron beam to a first position on the target in which the electron beam is substantially perpendicular to the curved target surface; and b) moving the focal spot on the target in a plane in which the target surface is curved from the first position of step a) to a second position on the target at which the electron beam is incident on the curved target surface at a flat angle, the electron beam thereby being deflected using an electric and/or magnetic field and/or a spot area of the focal spot being altered by changing a focusing of the electron beam using an electric and/or magnetic field, wherein a photon flux density of an x-ray beam formed by the x-ray optics is maximized in step a) and a photon flux of the x-ray beam is maximized in step b).

17. The method of claim 16, wherein the curved target surface has a radius of curvature R, with $0<R\leq 1$ mm.

* * * * *